US005117592A

United States Patent [19]

Preston

[11] Patent Number: 5,117,592

[45] Date of Patent: Jun. 2, 1992

[54] APPARATUS AND METHOD FOR ABRASIVE STRIP MOUNTING

[75] Inventor: Jay B. Preston, St. Paul, Minn.

[73] Assignee: Minnesota Mining and Manufacturing Company, St. Paul, Minn.

[21] Appl. No.: 490,932

[22] Filed: Mar. 9, 1990

[51] Int. Cl.[5] ..... B24B 45/00

[52] U.S. Cl. ..... 51/364; 51/367; 51/380

[58] Field of Search ..... 51/358, 364, 367, 368, 51/369, 370, 372, 374, 377, 379, 380, 387, 382, 384

[56] References Cited

U.S. PATENT DOCUMENTS

| | | | |
|---|---|---|---|
| 873,398 | 12/1907 | Wattles | 51/368 |
| 967,592 | 8/1910 | Wattles . | |
| 2,046,122 | 6/1936 | Hunt | 51/367 |
| 4,823,516 | 4/1989 | Matson | 51/367 |
| 4,977,712 | 12/1990 | Fisher et al. | 51/392 X |

FOREIGN PATENT DOCUMENTS

| | | | |
|---|---|---|---|
| 0003151 | 10/1991 | Sweden | 51/368 |

*Primary Examiner*—M. Rachuba
*Attorney, Agent, or Firm*—Kinney & Lange

[57] ABSTRACT

A rotatable wheel for removing material from a workpiece has a rigid circumferential surface on which a removable abrasive strip is mounted. The circumferential surface has a transverse slot extending into a cavity within the wheel which is generally covered by a coverplate secured over the cavity. Within the cavity is a first device for engaging the leading end of the strip and a second device for engaging the trailing end of the strip. The first device includes a positioner which is operable to align the first device under an opening in the coverplate to permit insertion or removal of the leading end of the strip. Similarly, the second device includes a locator arm which is operable to align the second device under an opening in the coverplate to permit insertion or removal of the trailing end of the strip. The first device places static tension on the strip, while the second device places dynamic tension on the strip as the wheel is rotated.

2 Claims, 5 Drawing Sheets

APPARATUS AND METHOD FOR ABRASIVE STRIP MOUNTING

BACKGROUND OF THE INVENTION

This invention relates to a tool for removing material from a workpiece. The tool has a rotatable wheel with an abrasive strip thereon which is easily replaceable and on which the tension is increased during rotation of the wheel.

Grinding wheels for grinders can be formed from solid discs of abrasive material. Alternatively, a strip of abrasive material has been wrapped around a wheel or drum to provide a grinding surface upon rotation of the wheel. To enable the abrasive strip to be capable of generating precision surfaces and fine finishes on a workpiece, the abrasive strip must be held on the wheel so that it always firmly engages the circumferential surface of the wheel during rotation of the wheel irrespective of the speed of rotation of the wheel.

Because the abrasive strips are subject to heat, wear and vibration which dislodges the abrasives from the strip, the abrasive strips must frequently be replaced. The grinders themselves usually provide limited access to the rotatable wheel for changing the strip because of the presence of the machinery necessary to rotate the wheel and position the wheel along the workpiece. Guards or protective housings are frequently placed about the rotatable wheel to prevent objects from inadvertently coming in contact with the wheel and to protect the operator. Because the abrasive strips must be replaced frequently and because of limited access to the wheel it is desirable to have a wheel which provides features for making the replacement of abrasive strips easier and faster.

One previously suggested means for holding a coated abrasive laminate material (CALM) strip on such a wheel has been to form a rim on the wheel with a large recess or cavity inside the rim. The wheel has a hub for mounting the wheel on the drive shaft of the grinder. The rim has a transverse slot providing communication from the recess to the exterior of the circumferential surface of the wheel so that the two ends of the CALM strip can enter into the recess. One end of the CALM strip is fastened into the recess by an eccentric lock, which tightens through the centrifugal forces developed during rotation of the wheel. The other end of the CALM strip is brought towards the center of the wheel and wrapped around a roller so that the end of the strip is pointed outwardly from the axis of rotation. This end of the strip is attached to a metal weight having a specific mass and positioned close to the roller to provide for the maximum distance for any stretching of the CALM strip. Rotation of the wheel causes the floating mass, through centrifugal force, to provide tension on one end of the CALM strip to keep it in its proper position. A counterbalance weight is employed to offset and correct for the imbalance created by the floating mass, the roller, and the eccentric lock. A coverplate extends over the cavity inside of the rim and has a hole to permit insertion of a tool for adjusting the initial tension on the CALM strip.

This arrangement for securing a CALM strip to a grinder wheel requires the removal of the coverplate for replacing the CALM strip. Removing the coverplate is time consuming and very difficult because of the limited access to the wheel in its operating environment. In addition, the coverplate and other parts (e.g., screws or fasteners) must be set aside and retained during CALM strip replacement, and are subject to loss. Furthermore, this design requires that the trailing end of the CALM strip be wrapped around a holding pin and inserted into the flying mass assembly, while the leading end must be threaded through the initial tensioning assembly which must then be rotated by a special tool to remove excess slack of the CALM strip and apply an initial tension to the CALM strip. Such manual manipulations can be difficult, especially when access to the wheel is limited by adjacent machinery.

Mattson U.S. Pat. No. 4,823,516 discloses a cutting tool having a rotatable wheel with a removable abrasive strip thereon. Removable endpieces are attached to the abrasive strip, which are then engaged by a mechanism within the circumferential surface to apply tension on each end of the strip in accordance with the speed of rotation of the wheel. The strip tensioning mechanism is located in a cavity within the circumferential surface and enclosed by a removable coverplate. Replacing-the abrasive strip requires removal of the coverplate. The endpieces must be removed from the old strip and installed on the new abrasive strip before the new strip can be installed. The coverplate then must be replaced and fastened into place.

Two U.S. Pat. Nos. issued to Wattles, 879,504 and 967,592, disclose a grinding or polishing wheel with a strip of flexible abrasive material detachably secured thereto. One end of the strip has an adjustable tension applied thereto, while the other end has a beaded end for retaining it in position within the wheel. The tensioning mechanisms shown in both of these Wattles patents are only partially enclosed by a coverplate, thereby allowing strip replacement without the removal of the coverplate. The arrangement in Wattles U.S. Pat. No. 879,504 requires the release of a pawl to allow the tensioning mechanism thereof to be forced against the tension of a spring into position for receiving the abrasive strip. Once aligned in its strip loading position, the tensioning mechanism is held in place by the pawl. The arrangement in Wattles U.S. Pat. No. 967,592 requires a tool to be inserted through the coverplate for positioning the tensioning mechanism for strip replacement, against the force of the tensioning spring, beneath a cutout in the coverplate adjacent the rim of the wheel.

Hunt U.S. Pat. No. 2,046,122 discloses a buffing and polishing wheel having a cushion on its circumferential surface on which an abrasive strip is mounted. Serrated endpieces are attached to the end of the strip and these endpieces are received by a tensioning mechanism in the wheel which then applies tension to the strip as a means for automatically taking up slack occurring in the abrasive strip (as a strip of coated abrasives is used, it stretches). Hunt shows the use of endpieces installed on the ends of the strip which must be compressed in order to grip the strip and hold the strip in the tensioning apparatus.

As noted in the exemplary references and devices discussed above, previous grinder strip-type tools for removing material from a workpiece required the removal of numerous parts during the replacement of the abrasive strip, which was difficult and time consuming. Each abrasive strip required the attachment of special endpieces for allowing the tensioning apparatus of the grinder wheel to engage the strip and withstand the large forces as the wheel turns at high speeds and the strip engages the workpiece.

SUMMARY OF THE INVENTION

The present invention provides a tool which has a rotatable wheel with a removable abrasive strip thereon for use in removing material from a workpiece. The present invention allows the abrasive strip to be replaced quickly and easily without necessitating the removal of a coverplate or other components. The present invention further provides an easy-to-use arrangement for removing initial slack from the strip, and for continually placing increasing tension on the strip as the wheel rotates and the strip stretches during use.

The present invention has a rotatable wheel with a substantially rigid circumferential surface. A transverse slot on the circumferential surface extends to a cavity within the wheel. The abrasive strip is removably mounted on the circumferential surface of the wheel, with the strip having an abrasive surface for removing material from a workpiece when the strip engages the workpiece during the rotation of the wheel. The strip has a leading end and a trailing end, with the leading end being the end of the strip first to come in contact with the workpiece after the transverse slot has passed the workpiece during rotation of the wheel. A first strip end receiver within the cavity engages the trailing end of the strip and a second strip end receiver within the cavity engages the leading end of the strip. The cavity is enclosed by a coverplate which is adapted to provide access to the first and second strip end receivers. A first locator is provided for positioning the first strip end receiver in a strip-loading position so as to allow access to the first strip end receiver via the coverplate. A second locator is provided for positioning the second strip end receiver in a strip-loading position so as to allow access to the second strip end receiver via the coverplate.

In one preferred embodiment of the invention, the strip has (1) a leading end with a first frusto-conical endpiece attached thereto which is adapted to be affirmatively received within a first portion of the wheel and (2) a trailing end having a second frusto-conical endpiece attached thereto which is adapted to be affirmatively received within a second portion of the wheel. Preferably, the first portion of the wheel is a first generally frusto-conical bore sized to tightly receive the first frusto-conical endpiece of the leading end of the strip, and the second portion of the wheel is a second generally frusto-conical bore sized to tightly receive the second frusto-conical endpiece of the trailing end of the strip.

DETAILED DESCRIPTION OF THE PREFERRED EMBODIMENTS

Figure 1:
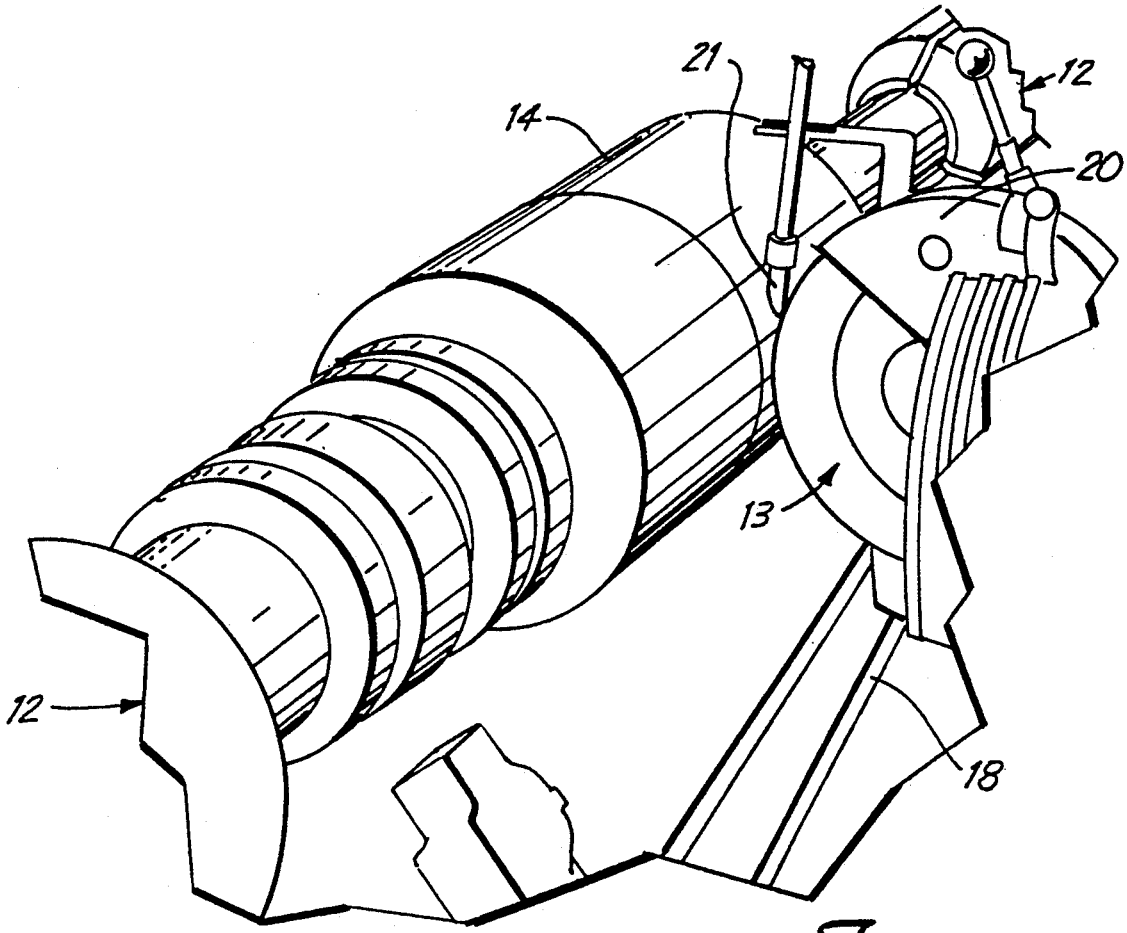
FIG. 1 is a perspective view of a typical precision grinding machine, showing a grinding wheel and workpiece.

FIG. 1 shows a typical machine 12 which uses a rotation wheel 13 to "finish" a workpiece 14 (e.g., grinding, polishing, buffing, etc.). Workpiece 14 is supported by machine 12 and may be rotatable. Wheel 13 is rotated by a motor which engages a hub portion 15 of wheel 13 (see FIG. 2). Wheel 13 has a circumferential outer rim of surface 16 which is aligned with the workpiece as illustrated in FIG. 1. A strip of abrasive material is mounted on this rim 16 (as discussed below) so that as the wheel 13 is rotated, it engages workpiece 14 to remove material therefrom. Wheel 13 is typically formed from a metal alloy and is relatively massive.

Machine 12 may be used to position workpiece 14 so as to engage rotating wheel 13, or as shown in FIG. 1, both workpiece 14 and wheel 13 may be aligned so as to selectively remove material from different portions of workpiece 14. For this purpose, wheel 13 is supported and moved laterally along tracks 18 of machine 12 along the side of workpiece 14, while machine 12 rotates workpiece 14 and wheel 13 is rotated. The position of wheel 13 along track 18 and the rotational position of workpiece 14 are controlled by a central controller such as a numerical controlled machine or microprocessor (not shown) for controlling how much material is removed and from what part of workpiece 14 the material is removed.

Wheel 13 is partially enclosed by wheel guard 20 to prevent any objects from inadvertently coming into contact with wheel 13 (which can be rotated at relatively high speeds) and protect the machine operator from inadvertently contacting the rapidly rotating wheel or from injury resulting from failure (and separation from the wheel) by the abrasive strip. In addition to guard 20, other components of machine 12 (e.g., motors, controls, frame, guide tracks, etc.) make access to wheel 13 difficult. Wheel 13 not only has limited access but is also usually in a wet and gritty environment (a lubricant/wash fluid is typically provided, as by nozzle 21 in FIG. 1, at the area where the workpiece is worked).

The dirty, gritty environment of the grinder and the limited access to wheel 13 make the periodic maintenance required by wheel 13 difficult. Because wheel 13 requires frequent maintenance such as changing the abrasive strip when the abrasive wears off and centering the strip on the circumferential surface, it is desirable that the wheel 13 and/or strip provide features to facilitate easy and fast changing and adjusting of the abrasive strip.

Figure 2:
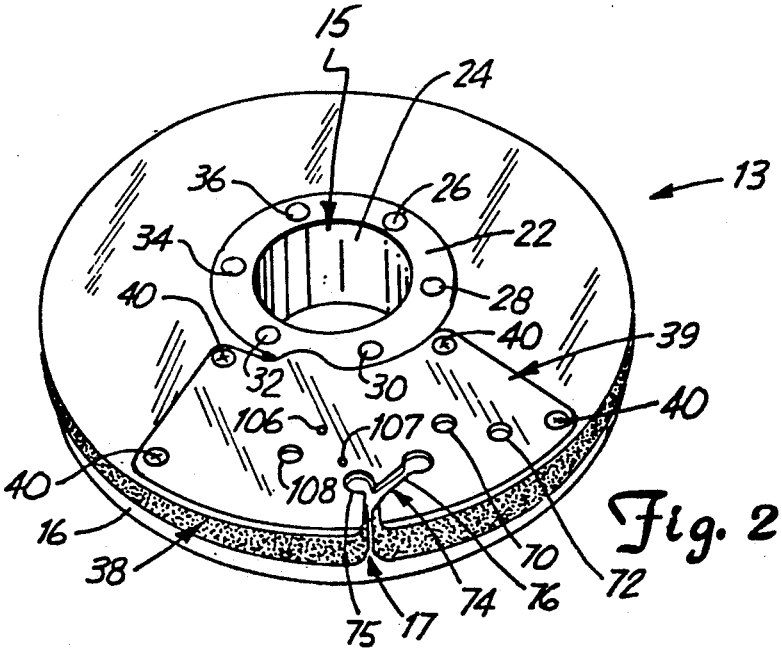
FIG. 2 is a perspective view of a rotatable grinder wheel of the present invention.

As illustrated in FIG. 2, the wheel 13 which is the subject of this invention has hub portion 15 having a hole in the center for receiving the machine drive shaft (not shown) and smaller holes 26, 28, 30, 32, 34, and 36 to facilitate operable engagement of wheel 13 with machine 12. Wheel 13 has an abrasive strip 38 strapped around its circumferential outer surface 16, with the strip 38 exiting and entering the interior of wheel 13 through a transverse slot 17 extending through circumferential outer surface 16. The components for holding the strip 38 tightly to the circumferential outer surface 16 are carried by and within the wheel 13, below a coverplate 39 which is secured to wheel 13 by a plurality of fasteners 40 (see FIG. 2).

Figure 3:
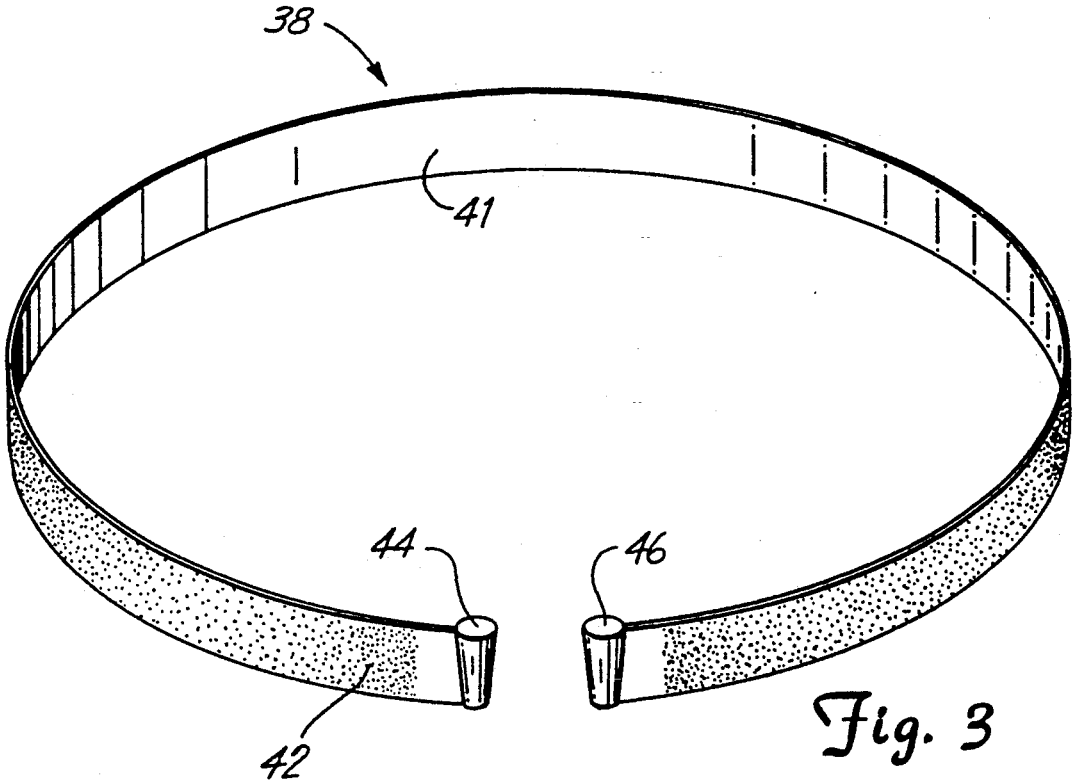
FIG. 3 is a perspective view of an abrasive strip for use with the tool of the present invention.
Figure 4:
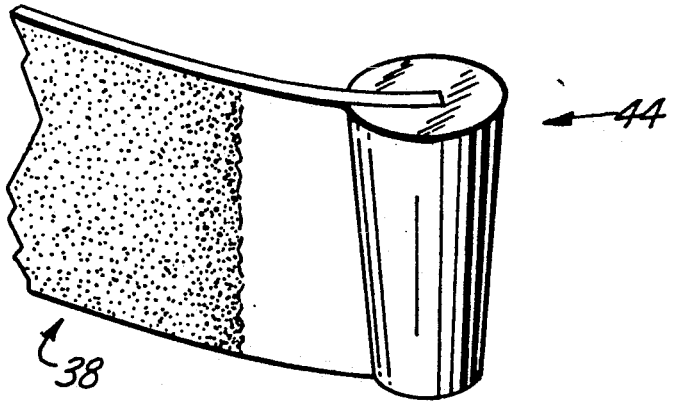
FIG. 4 is an enlarged perspective view of one end of the abrasive strip of the present invention.

The strip 38 shown in FIG. 2 and 3 has an inner surface 41 which is in contact with the circumferential surface of wheel 13 and an outer surface 42 which bears an abrasive coating. The outer abrasive surface 42 of strip 38 removes material from workpiece 14 as the abrasive surface 42 moves relative to and across the workpiece 14. The strip 38 also has endpieces 44 and 46 (see FIG. 3). These endpieces 44 and 46 each have a geometrically-defined shape, such a frusto-conical (see FIG. 4), and are attached permanently to their respective ends of strip 38.

Figure 5:
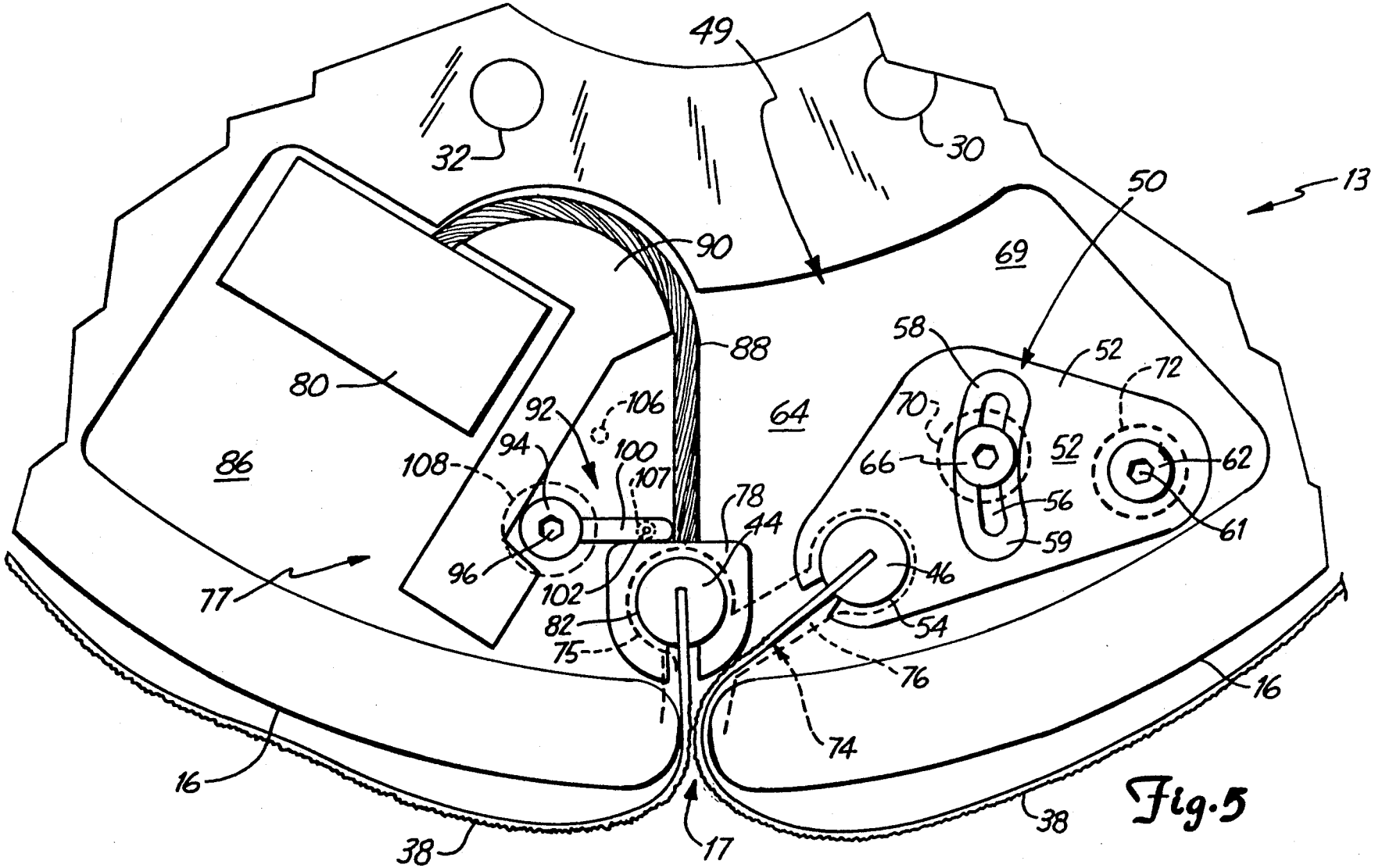
FIG. 5 is a fragmentary side elevational view of a portion of the rotatable wheel of the present invention, with the components thereof arranged in their strip loading positions.
Figure 6:
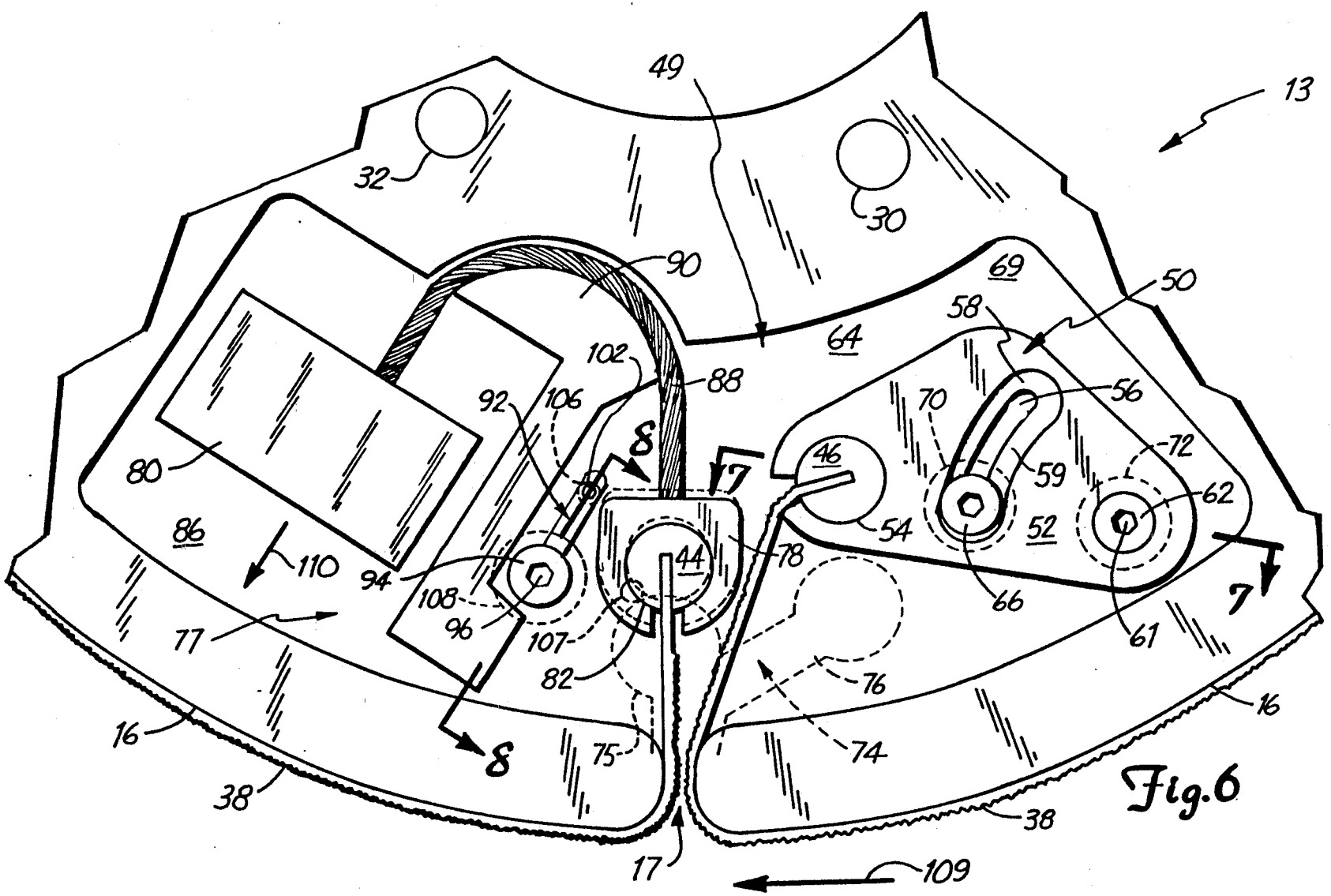
FIG. 6 is a fragmentary side elevational view of a portion of the rotatable wheel with the components thereof in their tension applying positions.
Figure 7:
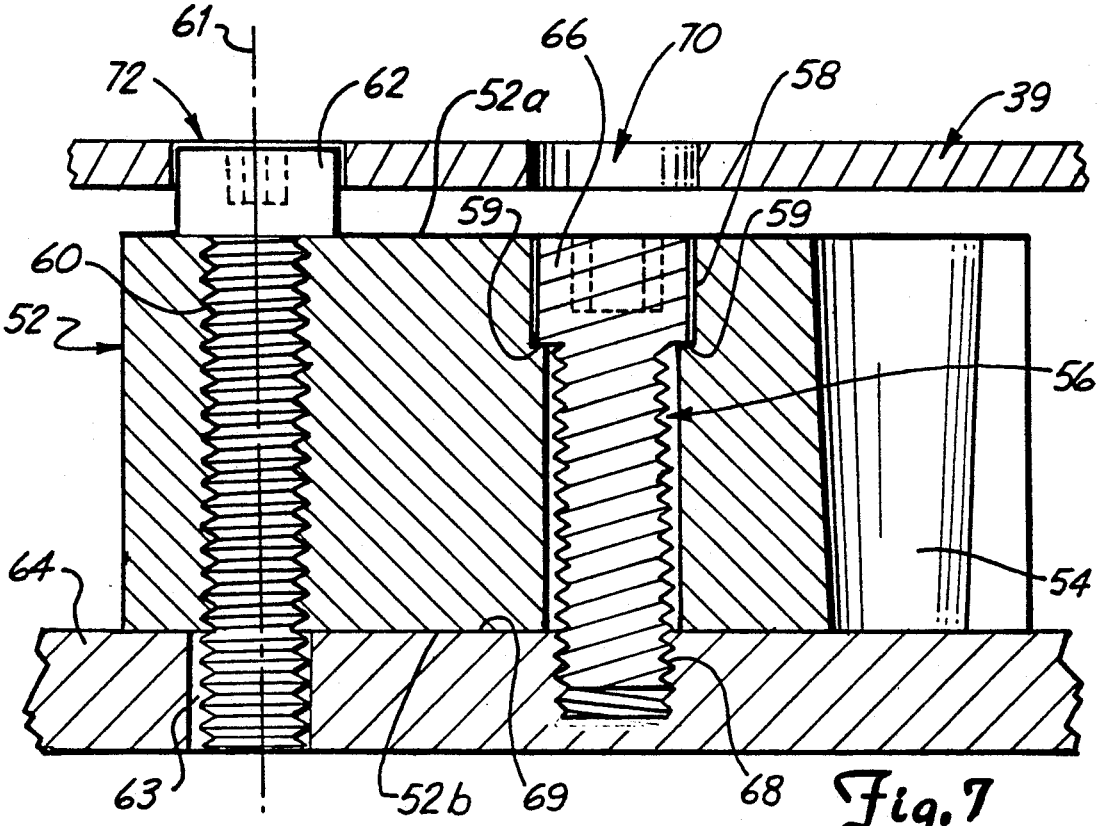
FIG. 7 is a sectional view as taken along line 7—7 in FIG. 6, with coverplate added.

FIGS. 5 and 6 illustrate an internal cavity 49 in wheel 13 containing the strip tensioning components located below coverplate 39. With coverplate 39 in place on wheel I3, access to cavity 49 is possible only through slot 17 in wheel 13 or through certain apertures in coverplate 39, as further explained below. Within internal cavity 49 of wheel I3 is a first strip gripper and tensioner device 50 for gripping endpiece 46 of strip 38. The first gripper/tensioner device 50 has a first member 52 which is substantially triangular in shape, has rounded corners and which, in one preferred embodiment, is milled from a solid block of aluminum. As seen in FIG. 7, first member 52 has an upper surface 52*a* and a lower surface 52*b*. At one end thereof, first member 52 has a geometrically-shaped bore 54 extending through its width, between its surfaces 52*a* and 52*b*. Preferably, bore 54 is generally cylindrical and the sides of bore 54 are slightly tapered. (see FIG. 7) with the end of the bore 54 opening to upper surface 52*a* being bigger than its other end (i.e., the bore is frusto-conically shaped). Centrally, first member 52 has an arcuate slot 56 passing through its entire width. The slot 56 has a slightly larger countersink slot portion 58 adjacent upper surface 52*a* which forms shoulders 59 along slot 56. At the other end of first member 52, a threaded bore 60 extends completely therethrough with first member 52 pivotally mounted within the cavity 49 about an axis 61 defined by threaded bore 60. A pivot pin, defined for example by an Allen head cap screw 62, is secured in the threaded bore 60 and extends through the width of the first member 52 and into an enlarged bore 63 in a backplate portion 64 of wheel 13, thus defining a pivotal connection between first member 52 and backplate portion 64 along axis 61.

First member 52 is secured to backplate portion 64 of wheel I3 by a suitable fastener such as an Allen head cap screw 66 extending-completely through the width of first member 52 in slot 56 and threaded into backplate portion 64 as at 68 of FIG. 7. Slot portion 58 is enlarged to accommodate the head of cap screw 66, so that the head is flush or below upper surface 52*a* of first member 52. Lower surface 52*b* of first member 52 slides across an inner surface 69 of backplate portion 64 when first member 52 is pivoted relative thereto. As seen in FIGS. 5 and 7, slot 56 and slot portion 58 are arcuate-shaped to define an arc about pivot axis 61 defined by bore 60. First member 52 is fixed in position along this arc by tightening cap screw 66 to engage its head with shoulders 59 of slot portion 58 and frictionally engage first member 52 with backplate portion 64 (along lower surface 52*b* and inner surface 69, respectively).

As seen in FIG. 2, coverplate 39 has apertures 70 and 72 therein (apertures 70 and 72 are also illustrated in phantom in FIGS. 5 and 6). These apertures allow access through the coverplate 39 to cap screws 62 and 66. Through aperture 70, cap screw 66 is loosened (via an appropriate tool such as an Allen wrench), and cap screw 62 (and first member 52 affixed thereto) is then accessed and rotated through aperture 72 in coverplate 39 to turn first member 52 about pivot axis 61.

Coverplate 39 also has an wheel rim slot 74 with wing portions 75 and 76. To couple strip 38 with first member 52, first member 52 is pivoted so that bore 54 is aligned under an enlarged circular area of wing portion 76 in coverplate 39 (see FIG. 5). First member 52 is retained in this position by tightening cap screw 66. Strip 38 is then inserted through slot 17 in the outer surface 16 of wheel I3, and endpiece 46 of strip 38 is inserted through wing portion 76 of slot 74 and into bore 54. As seen in FIGS. 5 and 7, the end of first member 52 is slotted along its width to provide an open slot alongside bore 54 for reception of strip 38. When so inserted, endpiece 46 of strip 38 is affirmatively received by the complimentary taper of bore 54.

First member 52 is moved about its pivot axis 61 to a tensioning position to remove slack in strip 38 and hold strip 38 tightly against the circumferential outer surface 16 of wheel 13, as shown in FIG. 6. Cap screw 66 is then tightened to fix first member 52 in position relative to wheel 13. In this position, bore 54 is no longer aligned under enlarged Wing 75 of slotted portion 74 in coverplate 39, so endpiece 46 is effectively "trapped" in place with respect to first member 52 by coverplate 39. Until first member 52 is pivoted back to its strip loading position (as in FIG. 5), endpiece 46 cannot be separated therefrom.

Endpiece 44 of strip 38 is received in a second strip gripper and tensioner device 77, also positioned within internal cavity 49 of wheel 13. The second gripper/tensioner device 77 includes a second member 78 and a tensioning body 80. The second member 78 is a generally rectangular block with a geometrically-shaped bore 82 extending therethrough. Preferably, bore 82 is generally cylindrical and the sides of bore 82 are slightly tapered like bore 54 of first member 52 (i.e., bore 82 is also frusto-conically shaped). The edges of second member 78 are rounded adjacent the outer rim of wheel 13, and the block is slotted alongside bore 82, as seen in FIG. 5. The other end of the strip 38 is thus passed through slot 17 in circumferential surface 16 of wheel 13, and endpiece 44 of strip 38 is then affirmatively received by the complementary taper of bore 82, while the adjacent slotted portion of second member 78 accommodates strip 38. In one preferred embodiment, second member 78 is milled from a solid block of aluminum.

Tensioning body 80 is a rectangular mass (preferably a block of steel or other relatively dense material) which is moveable radially along radial channel 86 formed within cavity 49 of wheel !3. Tensioning body 80 is constrained by channel 86, backplate 64 and coverplate 39 to move only in direction along a radius extending from the axis of rotation for the rotatable wheel 13.

Tensioning body 80 is connected to second member 78 by a link 88, which in one preferred embodiment consists of a pair of steel cables. Link 88 passes across a smooth arced member 90 within cavity 49 between second member 78 and tensioning body 80. Thus, any movement of tensioning body 80 radially outward pulls (through link 88) the second member 78 radially inwardly, away from the outer rim of wheel I3. As the rate of rotation of wheel I3 increases, the centrifugal forces acting on tensioning body 80 increase and greater urging forces through link 88 are thus applied to second member 78 (and thus applying greater tension to strip 38).

Figure 8:
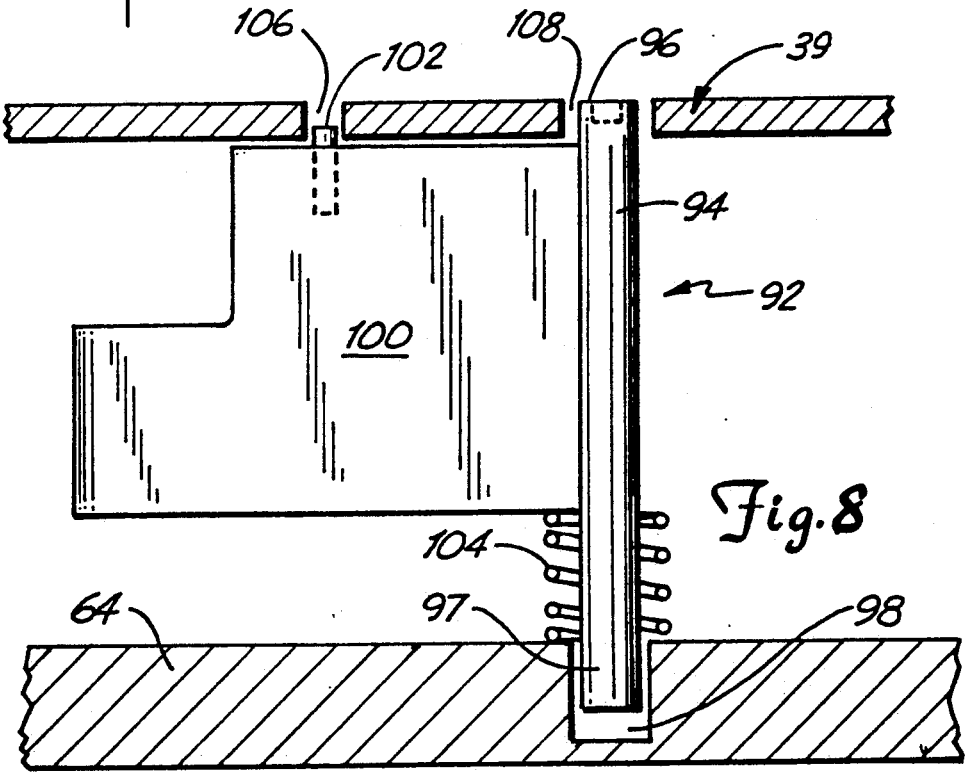
FIG. 8 is a cross sectional view as taken along line 8—8 in FIG. 6, with coverplate added.

To insert endpiece 44 of strip 38 into second member 78, second member 78 must be aligned under wing portion 75 of slot 74 in coverplate 39, as illustrated in FIG. 5. This is accomplished by means of a locator or positioner 92, as seen in FIGS. 5 and 8. In this manner, the second gripper/tensioner device 77 applies a tension to strip 38 in accordance with the speed of rotation of wheel 13.

Positioner 92 has a pivot shaft 94 with a an Allen head cap screw 96 at its top end. A bottom end 97 of shaft 94 fits loosely into a cylindrical bore 98 in backplate 64 of wheel 13. A wing 100 is attached to shaft 94 and has a pin 102 extending outwardly from an upper edge thereof (see FIG. 8). A coil spring 104 is positioned about shaft 94 between wing portion 100 and backplate 64 to bias the positioner 92 away from backplate 64 and toward coverplate 39. Coverplate 39 has pin apertures 106 and 107 which serve to define fixed positions for the positioner 92 as it is pivoted about shaft 94. Coverplate 39 also has an aperture 108 (aligned above bore 98 in backplate 64) for reception of top end 96 of shaft 94.

Aperture 108 in coverplate 39 allows the insertion of a hex tool into cap screw 96 of shaft 94 so that, by first applying a force against spring 104, pin 102 is lowered to clear aperture 106 or 107, thereby allowing torque to be applied by the hex tool to rotate or pivot positioner 92 between its positions as defined by apertures 106 and 107. In the position seen in FIG. 5, the second member 78 is aligned under the wing portion 75 of slot 74 in coverplate 39. To retain second member 78 in this position, positioner 92 is pivoted to the position seen in FIG. 5, wherein pin 102 is received within aperture 107 in coverplate 39. Indeed, rotation of positioner 92 to this position forces wing 100 thereof against a generally planar back surface of second member 78 to urge it into a position whereby bore 82 is under a circular area of wing portion 75. In so doing, tensioning body 80 is pulled radially inwardly relative to wheel 13, through link 88 attached to second member 78. Once second member 78 is so positioned (in a strip loading position), endpiece 44 of strip 38 can be inserted through slot 74 in coverplate 39 and into bore 82 in second member 78. As mentioned above, the endpiece 44 and bore 82 are preferably frusto-conical and have complimentary tapers, allowing these two components to engage tightly. FIG. 5 illustrates the gripper/tensioner devices 50 and 77 aligned for reception of their respective endpieces 46 and 44 of strip 38. As seen in FIG. 5, strip 38 is loosely fitted about the cylindrical outer surface 16 of wheel 13 during loading.

In order to permit the tensioning body 80 to further apply tension to strip 38 during rotation of wheel 13, positioner 92 must be unlocked and pivoted away from second member 78. FIG. 6 illustrates positioner 92 so moved, so that it does not interfere with movement of second member 78 caused by radial movement of tensioning body 80. In this second position, positioner 92 is pivoted about the axis defined by its shaft 94 to position whereby pin 102 is received within aperture 106 in coverplate 39. FIG. 6 also illustrates that rotation of wheel 13 (preferably clockwise as viewed in FIG. 6 and as indicated by arrow 109) causes tensioning body 80 to move radially outwardly (in direction of arrow 110 in FIG. 6) to thereby move second member 78 radially inwardly. This in turn moves bore 82 of second member 70 out of alignment with wing portion 75 of slot 74 through coverplate 39, thereby effectively "trapping" endpiece 44 within second member 78 and under coverplate 39. Until second member 78 is moved back to its strip loading position (as in FIG. 5), endpiece 44 cannot be separated therefrom.

Operation and use of the wheel 13 of this invention involves the following steps. The first gripper/tensioner device 50 is positioned in its first strip loading position (see FIG. 5) by inserting a suitable tool through aperture 70 in coverplate 39 and into the fastener 66. The fastener 66 is loosened to allow first member 52 to move freely about the pivot axis 61 (cap screw 62). The tool is then placed through aperture 72 in coverplate 39 and into cap screw 62. As the tool is rotated counterclockwise, cap screw 62 pivots along with the first member 52 about its pivot axis 61 (see FIG. 7) until the bore 54 is aligned beneath wing portion 76 of slot 74 in coverplate 39 (see FIG. 5). The tool is then used to tighten fastener 66 and lock first member 52 in its first strip loading position (see FIG. 5).

A suitable tool is then be placed through bore 108 in coverplate 39 to engage positioner 92. Sufficient force applied downwardly towards backplate 64 of wheel 13 compresses spring 104, thereby allowing pin 102 to clear aperture 106 and allowing rotation of the positioner 92 about its pivot shaft 94. As positioner 92 is rotated, it engages second member 78 and urges it into a strip loading position, with second member 78 aligned beneath wing portion 75 of slot 74 in coverplate 39 (see FIG. 5). Once pivoted, the downward force on the positioner 92 is released, allowing pin 102 to engage aperture 107 in coverplate 39 and thus lock second member 78 in a strip loading position (as seen in FIG. 5).

Strip 38 is then wrapped around the circumferential outer surface 16 of wheel 13 with the abrasive outer surface 42 of strip 38 facing away from the circumferential outer surface 16. The leading endpiece 46 of strip 38 is inserted through slot 17 in wheel 13 and through wing portion 76 of slot 74 and into bore 54 in first member 52 (see FIG. 5). Similarly, the trailing endpiece 44 of strip 38 is inserted through slot 17 in wheel 13 and through wing portion 75 of slot 74 (see FIGS. 2 and 5) into bore 82 in second member 78 (see FIG. 5).

An initial tension is applied to strip 38 to remove slack by releasing the fastener 66, and pivoting first member 52 to position as seen in FIG. 6. Fastener 66 is then tightened to lock first member 52 in a strip loaded position (see FIG. 6). In this position, strip 38 lies tightly about the circumferential outer surface 16 of wheel 13.

The positioner 92 is then released from its strip loading position (as seen in FIG. 5) by applying a downward force on the shaft 94 while turning the positioner 92 until pin 102 aligns with the aperture 106, thus locking the positioner 92 in a storage position (see FIG. 6), out of the way of second member 78.

When so assembled, a leading end portion of strip 38 (with endpiece 46 attached thereto) is thus fixed in place relative to wheel 13, while a trailing end portion of strip 38 (with endpiece 44 attached thereto) is movable radially inwardly with respect to wheel 13 as wheel 13 is rotated to pull slack from strip 38 during use thereof. Rotation of wheel 13 causes tensioning body 80 to move radially outwardly, thereby pulling on endpiece 44 of strip 38 through link 88 and second member 78, to pull strip 38 taut about circumferential outer surface 16 about wheel 13 at all times during use.

To replace the strip, the steps described above are reversed. In other words, once wheel rotation is stopped, positioner 92 is pivoted to locate its pin 102 within aperture 107 in coverplate 39. This moves second member 78 back into alignment under wing portion 75 of slot 74, thereby permitting removal of endpiece 44 from second member 78. Similarly, a loosening of fastener 66 permits the pivoting of first member 52 back to position wherein its bore 54 is aligned under wing portion 76 of slot 74 in coverplate 39, thereby permitting removal of endpiece 46 from first member 52. At all times during insertion, tightening or replacement of a strip using the tensioning and gripping arrangement of the present invention, the coverplate remains in place over the components.

The present invention requires a minimal number of steps to change the abrasive strip and does not require the removal of any parts which may get lost or fall into the machinery. The strip changing scheme of the present invention also allows the coverplate to remain in place when changing an abrasive strip—strip insertion and adjustment of the tensioning components for the strip is achieved through holes in the coverplate (which are kept to a minimal size to keep out dirt and grit from the tensioning apparatus).

The present invention makes use of geometrically-shaped, self-aligning strip ends which facilitate the insertion and removal of those strip ends into and out of their respective receiving bores. These permanent strip ends do not require any adjustment, measuring or further installation because they come with the strip. Preferably, the endpieces are formed from a polymeric material, or they may be made from steel or aluminum.

Although the present invention has been described with reference to preferred embodiments, workers skilled in the art will recognize that changes may be made in form and detail without departing from the spirit and scope of the invention. For instance, the coverplate may be provided with a movable or slidable plate to take the place of the openings allowing access to the strip tensioning components in the wheel cavity. Furthermore, although the positioner 92 is described as pivotally movable between its positions defined by apertures 106 and 107, it is contemplated that positioner 92 could simply slide between positions rather than pivot.

What is claimed is:

1. A strip for use with a rotatable wheel adapted for removing material from a workpiece, the strip having an inner surface in contact with a circumferential surface of the rotating wheel and an outer surface having an abrasive means thereon for engaging the workpiece and thereby removing material, the strip further comprising:

a leading end substantially permanently and non-compressibly embedded in a first frusto-conical endpiece, said first endpiece affirmatively received within a first generally frusto-conical bore portion of the wheel; and a tailing end permanently and non-compressibly embedded in a second frusto-conical endpiece, said second endpiece affirmatively received within a second generally frusto-conical bore portion of the wheel.

2. A tool for removing material from a workpiece, the tool comprising:

a rotatable wheel having a circumferential surface with a transverse slot extending through the circumferential surface and extending to a cavity within the wheel;

a strip removably mounted on the circumferential surface of the wheel, the strip having an abrasive surface for removing material from a workpiece when the strip engages the workpiece during rotation of the wheel, the strip further having a leading end and a trailing end, with the leading end being the end of the strip first to come in contact with the workpiece after the transverse slot has passed the workpiece during rotation of the wheel, with the leading end and the trailing end each being enlarged and having a frusto-conical shape; and a first strip end receiver within the cavity for engaging the frusto-conical leading end of the strip, with the first strip end receiver having a first bore which is complementarily shaped to receive the frusto-conical leading end of the strip in a mating relationship and a second strip end receiver within the cavity for engaging the frusto-conical trailing end of the strip, with the second strip end receiver having a second bore which is complementarily shaped to receive the frusto-conical trailing end of the strip in a mating relationship.

* * * * *